US009542872B2

(12) United States Patent
Huang et al.

(10) Patent No.: US 9,542,872 B2
(45) Date of Patent: Jan. 10, 2017

(54) DATA DRIVER FOR ELECTROPHORETIC DISPLAY

(71) Applicant: NOVATEK MICROELECTRONICS CORP., Hsinchu (TW)

(72) Inventors: Shih-Hung Huang, Zhubei (TW); Feng-Ting Pai, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 284 days.

(21) Appl. No.: 13/842,600

(22) Filed: Mar. 15, 2013

(65) Prior Publication Data

US 2014/0002435 A1 Jan. 2, 2014

(30) Foreign Application Priority Data

Jun. 27, 2012 (TW) ..... 101123083 A

(51) Int. Cl.
*G09G 3/00* (2006.01)
*G09G 3/34* (2006.01)

(52) U.S. Cl.
CPC ..... *G09G 3/00* (2013.01); *G09G 3/344* (2013.01); *G09G 2310/0275* (2013.01); *G09G 2310/06* (2013.01)

(58) Field of Classification Search
CPC ..... G02F 1/1343; G09G 3/3233; G09G 3/36; G09G 5/00; G09G 3/00; G09G 3/3655; G09G 3/344; G09G 2310/06; G09G 2310/0275; G06F 3/038
USPC ..... 345/90, 100, 211, 212; 349/39
See application file for complete search history.

(56) References Cited

U.S. PATENT DOCUMENTS

2002/0063668 A1* 5/2002 Yoon ..... G09G 3/3685 345/87
2008/0284771 A1* 11/2008 Matsuki ..... 345/211
2010/0079691 A1* 4/2010 Yoshii ..... G02F 1/134336 349/39
2013/0127806 A1* 5/2013 Wu ..... G09G 3/3688 345/211

* cited by examiner

*Primary Examiner* — Lun-Yi Lao
*Assistant Examiner* — Johny Lau
(74) *Attorney, Agent, or Firm* — Rabin & Berdo, P.C.

(57) ABSTRACT

A data driver for an electrophoretic display (EPD) includes multiple driver sub-circuits. Each of the driver sub-circuits includes first and second latches, first and second capacitors, a multiplexer and a comparator. The first and second latches respectively provide updated latch image data and current latch image data in response to original image data. When the updated and current latch image data correspond to different levels, the comparator controls the multiplexer in a first period to selectively couple one of the first and second capacitors to a driver end, so as to recycle charges at pixels, and controls the multiplexer in a second period to selectively couple the other of the first and second capacitors to the driver end to pre-charge the pixels with the charges.

12 Claims, 14 Drawing Sheets

| | Vin_L' | Vin_L | W1 | W4 | W2 | W3 |
|---|---|---|---|---|---|---|
| 1 | GND | GND | GND | GND | GND | Nd |
| 2 | VPOS | GND | Cpos | GND | GND | Nd |
| 3 | VNEG | GND | Cneg | GND | GND | Nd |
| 4 | GND | VPOS | GND | GND | Cpos | Nd |
| 5 | VPOS | VPOS | Nd | Nd | Nd | Nd |
| 6 | VNEG | VPOS | Cneg | GND | Cpos | Nd |
| 7 | GND | VNEG | GND | GND | Cneg | Nd |
| 8 | VPOS | VNEG | Cpos | GND | Cneg | Nd |
| 9 | VNEG | VNEG | Nd | Nd | Nd | Nd |

FIG. 4

| | Vin_L' | Vin_L | W1 | W2 | W3 |
|---|---|---|---|---|---|
| 1 | GND | GND | GND | GND | Nd |
| 2 | VPOS | GND | Cpos | GND | Nd |
| 3 | VNEG | GND | Cneg | GND | Nd |
| 4 | GND | VPOS | GND | Cpos | Nd |
| 5 | VPOS | VPOS | Nd | Nd | Nd |
| 6 | VNEG | VPOS | Cneg | Cpos | Nd |
| 7 | GND | VNEG | GND | Cneg | Nd |
| 8 | VPOS | VNEG | Cpos | Cneg | Nd |
| 9 | VNEG | VNEG | Nd | Nd | Nd |

FIG. 5

| | Vin_L' | Vin_L | W1_1 | W1_2 | • • • | W1_k | W4 | W2_k | W2_k-1 | W2_1 | W3 |
|---|---|---|---|---|---|---|---|---|---|---|---|
| 1 | GND | GND | GND | GND | • • • | GND | GND | GND | GND | GND | Nd |
| 2 | VPOS | GND | Cpos_1 | Cpos_2 | • • • | Cpos_k | GND | GND | GND | GND | Nd |
| 3 | VNEG | GND | Cneg_1 | Cneg_2 | • • • | Cneg_k | GND | GND | GND | GND | Nd |
| 4 | GND | VPOS | GND | GND | • • • | GND | GND | Cpos_k | Cpos_k-1 | Cpos_1 | Nd |
| 5 | VPOS | VPOS | Nd | Nd | • • • | Nd | Nd | Nd | Nd | Nd | Nd |
| 6 | VNEG | VPOS | Cneg_1 | Cneg_2 | • • • | Cneg_k | GND | Cpos_k | Cpos_k-1 | Cpos_1 | Nd |
| 7 | GND | VNEG | GND | GND | • • • | GND | GND | Cneg_k | Cneg_k-1 | Cneg_1 | Nd |
| 8 | VPOS | VNEG | Cpos_1 | Cpos_2 | • • • | Cpos_k | GND | Cneg_k | Cneg_k-1 | Cneg_1 | Nd |
| 9 | VNEG | VNEG | Nd | Nd | • • • | Nd | Nd | Nd | Nd | Nd | Nd |

FIG. 8

DATA DRIVER FOR ELECTROPHORETIC DISPLAY

This application claims the benefit of Taiwan application Serial No. 101123083, filed Jun. 27, 2012, the subject matter of which is incorporated herein by reference.

TECHNICAL FIELD

The disclosure relates in general to a data driver for an electrophoretic display (EPD), and more particularly to an EPD data driver having a charge recycling mechanism.

BACKGROUND

In a modern world with ever-progressing technology, display-associated techniques such as electrophoretic displays (EPDs) are developed for providing convenience in the daily life. In general, an EPD, featuring high reflectivity, high contrast and capability of sustaining stable images, is common in electronic books to provide users with simulation of ordinary ink on conventional paper. Therefore, researchers and developers of the industry constantly seek for a display driving mechanism with enhanced power efficiency for an EPD.

SUMMARY

According to an example the present disclosure, a data driver for an electrophoretic display (EPD) is provided. The data driver includes multiple driver sub-circuits, each of which drives a pixel column within a driving period via a driver end. Each of the driver sub-circuits includes an output node, first and second latches, first and second capacitors, a multiplexer and a comparator. The first and second latches respectively store updated latch image data and current latch image data in response to original image data. The second latch further provides the current latch image data to the output node. The updated and current latch image data selectively correspond to one of positive, negative and ground reference levels, respectively. The multiplexer is coupled to the first capacitor, the second capacitor, the output node and the driver end. The comparator divides the driving period into first, second and third periods. When the updated and current image data correspond to different levels, the comparator controls the multiplexer to selectively couple one of the first and second capacitors to the driver end in the first period, so as to recycle charges of the pixel column. The comparator further controls the multiplexer to selectively couple the other of the first and second capacitors to the driver end in the second period, so as to pre-charge the pixels with the charge.

According to another example of the present disclosure, a data driver for an EPD is provided. The data driver includes multiple driver sub-circuits, each of which drives a pixel column within a driving period via a driver end. Each of the driver sub-circuits includes an output node, a ground power rail, first and second latches, first and second capacitors, a multiplexer and a comparator. The ground power rail provides a ground reference level. The first and second latches respectively store updated latch image data and current latch image data in response to original image data. The second latch further provides the current latch image data to the output node. The updated and current latch image data selectively correspond to one of positive, negative and ground reference levels, respectively. The multiplexer is coupled to the first capacitor, the second capacitor, the output node, the driver end and the ground power rail. The comparator divides the driving period into first to fourth periods. When the updated and current image data correspond to different levels, the comparator controls the multiplexer to selectively couple one of the first and second capacitors to the driver end in the first period, so as to recycle charges at the pixel column, and to selectively couple the other of the first and second capacitors to the driver end in the second period, so as to pre-charge the pixels with the charge. The comparator further controls the multiplexer to selectively couple the ground power rail to the driver end in the fourth period. The fourth period is triggered between the first and second periods.

The above and other contents of the disclosure will become better understood with regard to the following detailed description of the preferred but non-limiting embodiments. The following description is made with reference to the accompanying drawings.

BRIEF DESCRIPTION OF THE DRAWINGS

FIG. 4 is a table listing operations of a multiplexer 111 according to an embodiment of the present disclosure.

FIG. 5 is another table listing operations of a multiplexer 111 according to an embodiment of the present disclosure.

FIG. 8 is a table listing operations of a multiplexer 111' according to an embodiment of the present disclosure.

Figure 1:
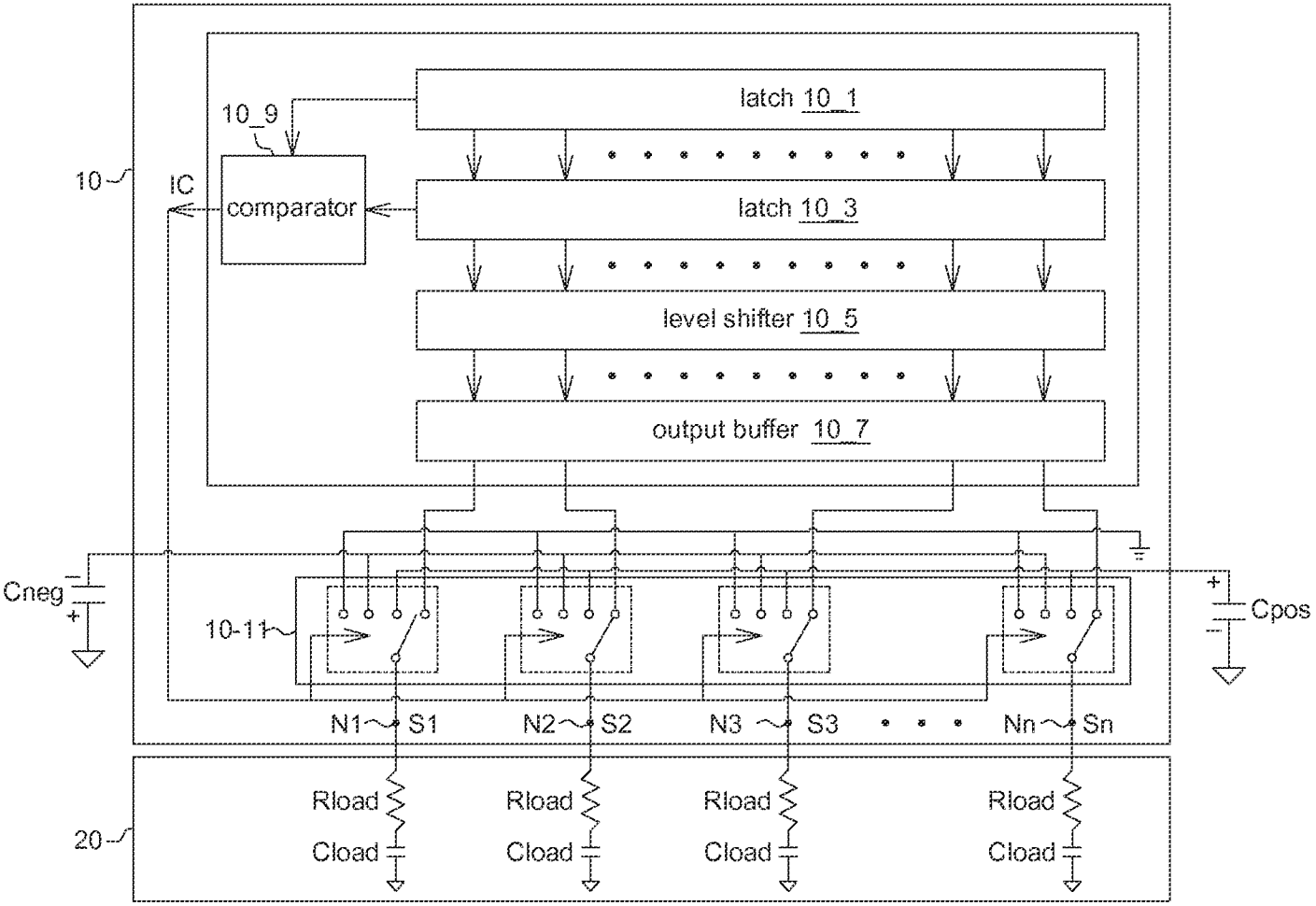
FIG. 1 is a block diagram of an EPD according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details.

In other instances, well-known structures and devices are schematically shown in order to simplify the drawing.

DETAILED DESCRIPTION OF THE DISCLOSURE

A data driver for an electrophoretic display (EPD) is provided by the embodiments below. Through time-division multiplexing, positive and negative charges at pixel columns is recycled.

FIG. 1 shows a block diagram of an EPD according to an embodiment of the present disclosure. Referring to FIG. 1, an EPD 1 includes a data driver 10 and an EPD panel 20. For example, the EPD panel 20 has a pixel array including m*n pixels, where m and n are natural numbers greater than 1. Further, structure of the EPD panel 20 according to the embodiment is not defined here, and associated details are omitted herein. In FIG. 1, in this embodiment, equivalent resistance Rload and equivalent capacitance Cload of n pixels columns in the EPD panel 20 are depicted in representation.

The data driver 10 includes first and second latches 10_1 and 10_3, a level shifter 10_5, an output buffer 10_7, a comparator 10_9 and a multiplexer 10_11. For example, each of the foregoing circuits correspondingly includes n units. The n units correspondingly form n driver sub-circuits 10(1), 10(2), . . . , and 10(*n*), each of which including n driver ends N1, N2, . . . , and Nn for respectively driving n pixel columns in the pixel array.

The data driver 10 further includes capacitors Cpos and Cneg for respectively storing recycled charges at the pixels of the n pixel columns. As the driver sub-circuits have a substantially same circuit structure, an $i^{th}$ driver sub-circuit is taken as an example for illustrating details of operations of the n driver sub-circuits of the data driver 10 according to the embodiment, where i is a natural number small than or equal to n.

Figure 2:
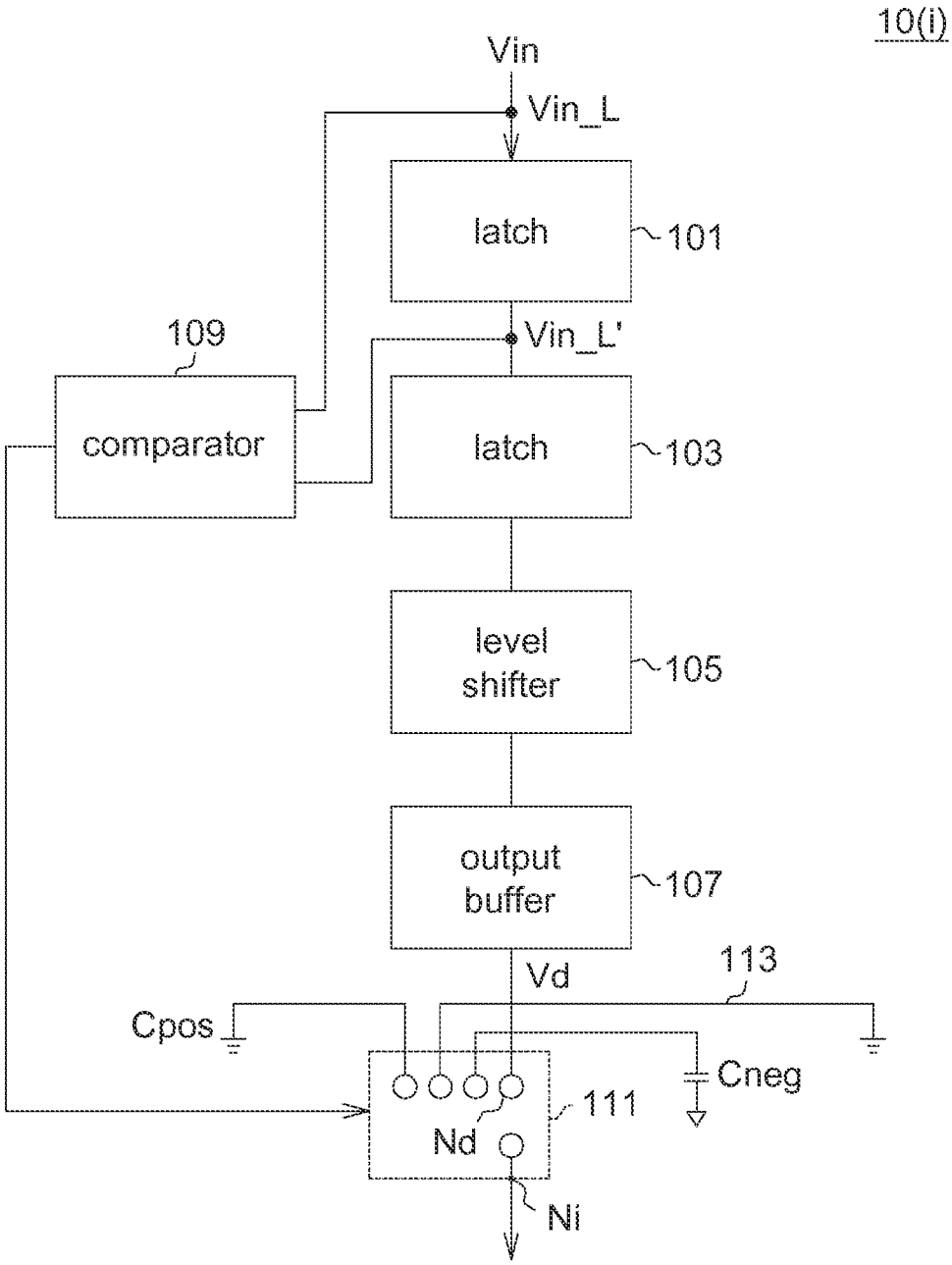
FIG. 2 is a detailed block diagram of a driver sub-circuit 10(*i*) in FIG. 1.
Figure 3:
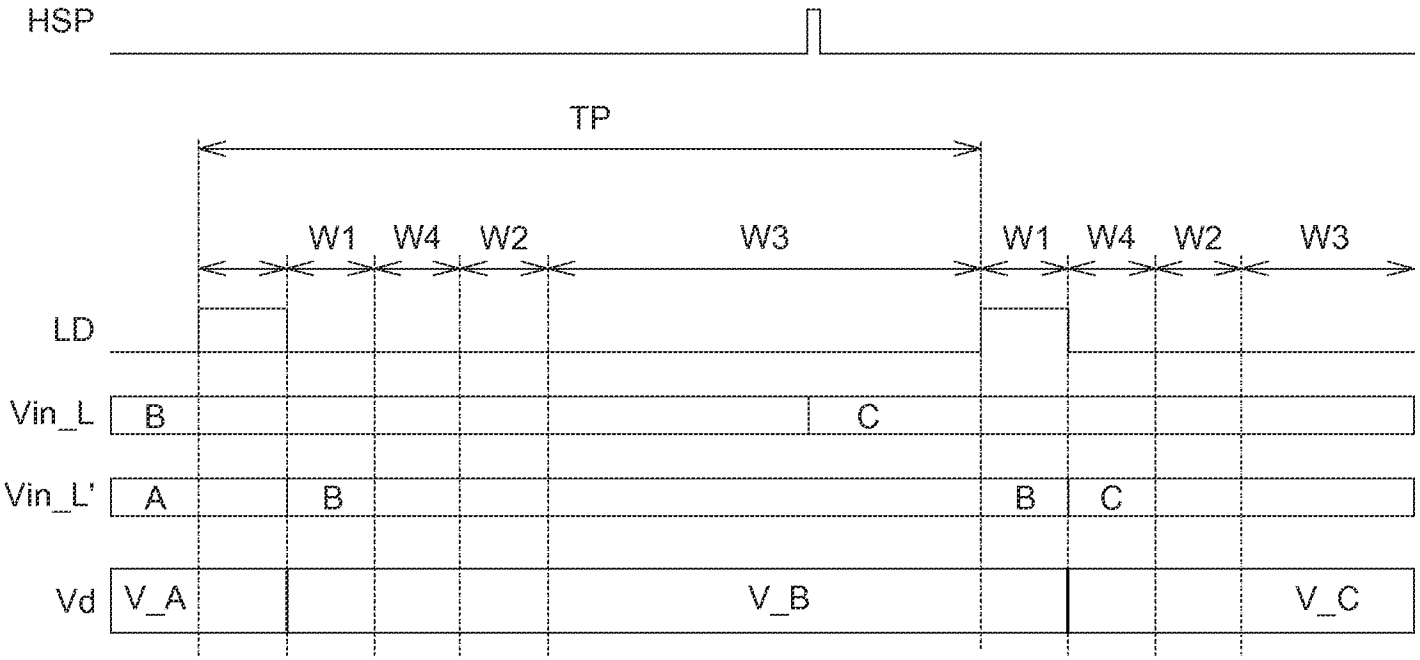
FIG. 3 is a timing diagram of operations of the driver sub-circuit 10(*i*).
Figure 6A:
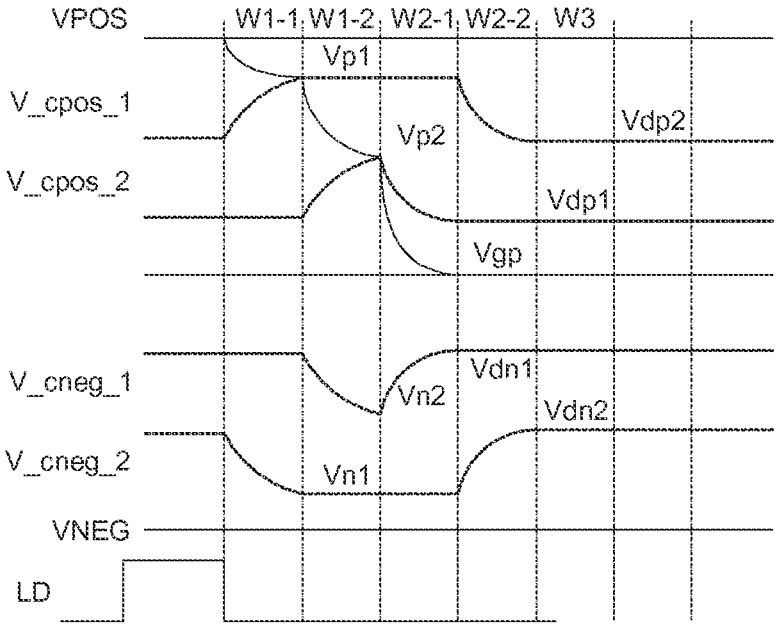
FIGS. 6A to 6F are timing diagrams of associated signals in a driver sub-circuit 10(*i*)'.
Figure 6B:
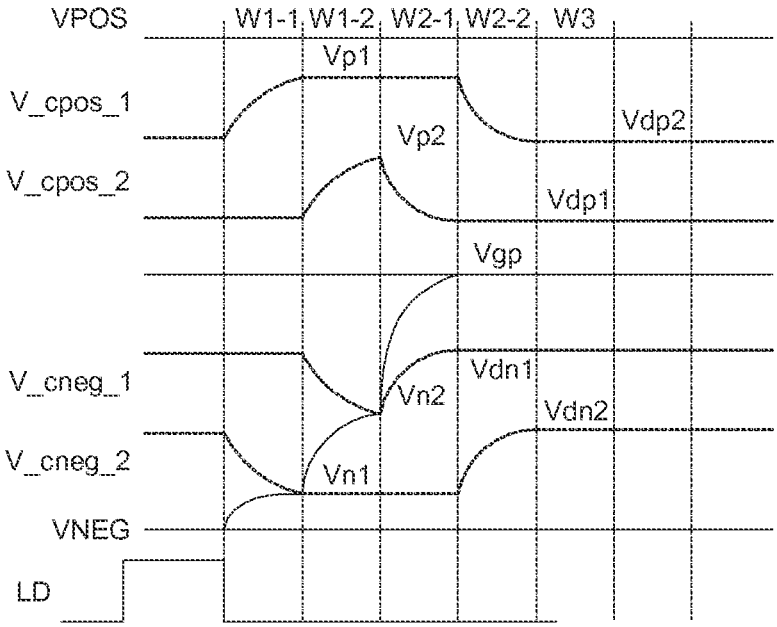
Figure 6C:
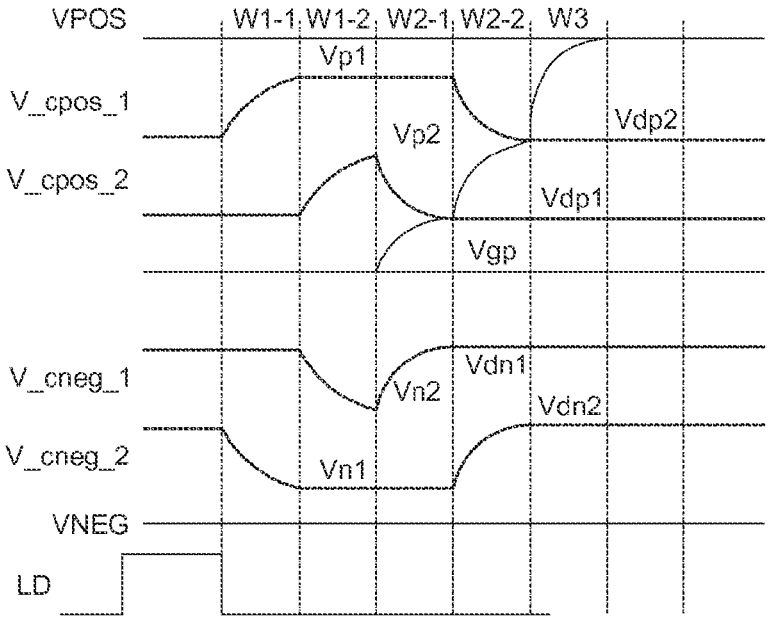
Figure 6D:
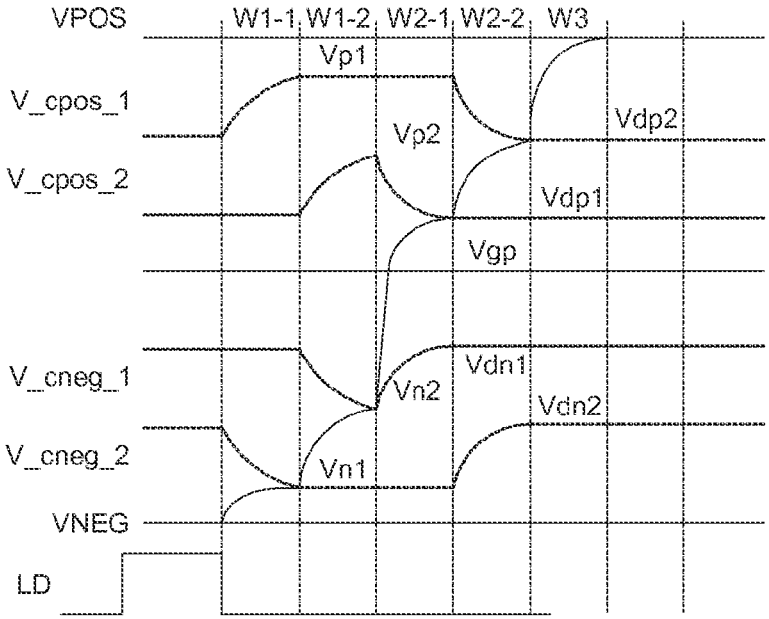
Figure 6E:
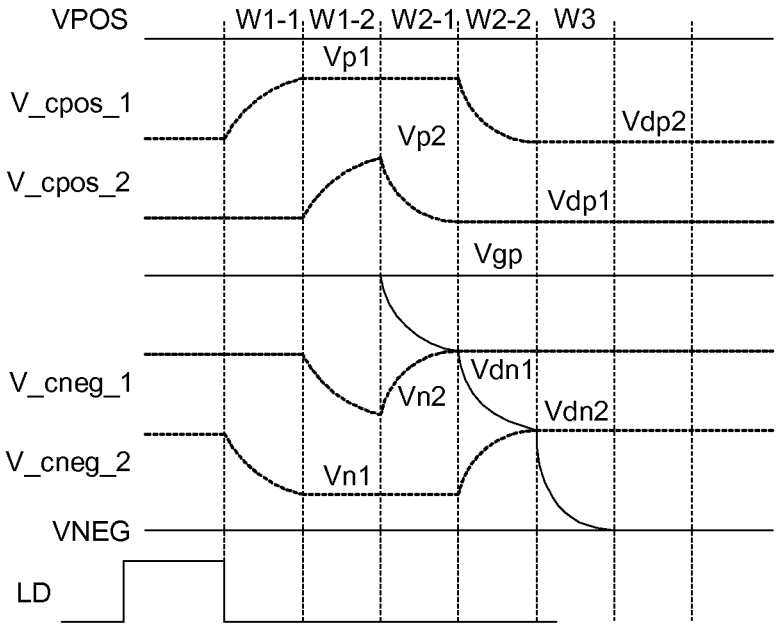
Figure 6F:
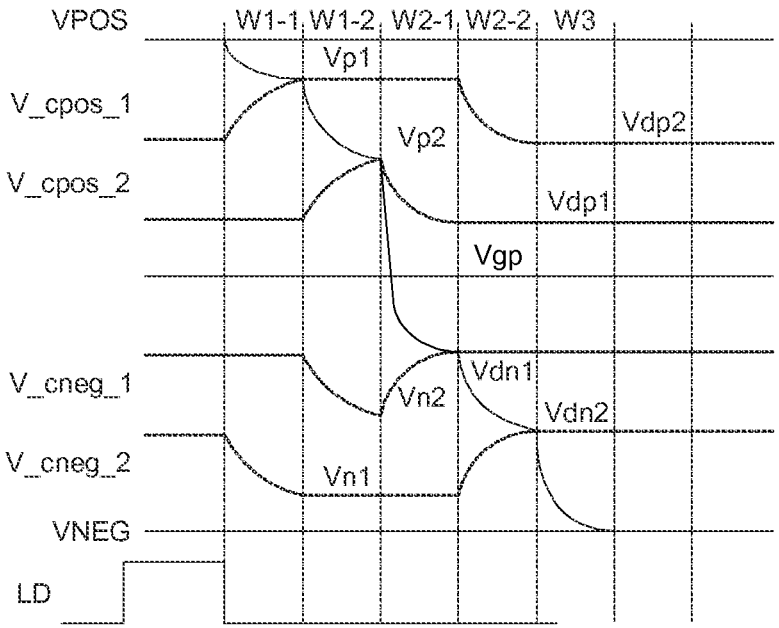

FIG. 2 shows a detailed block diagram of a driver sub-circuit 10(*i*) in FIG. 1. The driver sub-circuit 10(*i*) includes a latch 101, a latch 103, a level shifter 105, an output buffer 107, a comparator 109, a multiplexer 111 and an output node Nd.

Latch image data Vin_L' and Vin_L may be respectively regarded as frame data of original image data Vin corresponding to different time points. The latch 101 receives the original image data Vin, and writes the updated latch image data Vin_L corresponding to a current timing period in response to a load control signal HSP provided by an external timing controller. The latch 103 writes the current latch image data Vin_L' in response to a falling edge of a load control signal LD provided by the external timing controller. For example, the current and updated latch image data are image data of $(s-1)^{th}$ and $5^{th}$ frames in the original image data Vin, where s is a natural number.

The level shifter 105 and the output buffer 107 further correspondingly perform corresponding operations on the current latch image data Vin_L' to provide a driving signal Vd to the output node Nd. For example, the original image data Vin, the current latch image data Vin_L' and the updated latch image data Vin_L selectively correspond to one of positive, negative and ground reference levels VPOS, VNEG and GND, respectively. The corresponding driving signal Vd selectively corresponds to one of three levels +15V, −15V and GND.

For example, the multiplexer 109 has four inputs and an output. The inputs of the multiplexer 109 are respectively coupled to the capacitors Cpos and Cneg, the ground power rail 113 and the output node Nd. The output of the multiplexer 109 is coupled to the driver end Ni.

The comparator 109 divides the driving period TP into periods W1, W2, W3 and W4, as shown in FIG. 4. Based on levels of the current and updated latch image data Vin_L' and Vin_L, the comparator 109 provides a control signal IC in the periods W1 to W4 to switch the multiplexer 111, thereby performing a time-division multiplexing operation on the $i^{th}$ pixel column. When the current and updated latch image data Vin_L' and Vin_L correspond to different levels, the driver sub-circuit 10(*i*) drives and switches the level of the driving signal Vd.

Accordingly, the comparator 109 controls the multiplexer 111 to selectively couple one of the capacitors Cpos and Cneg to the driver end Ni in the period W1, so as to recycle charges at the $i^{th}$ pixel column. The comparator 109 controls the multiplexer 111 to selectively couple the other of the capacitors Cpos and Cneg to the driver end Ni in the period W2, so as to pre-charge the $i^{th}$ pixel column by the recycled charges. The comparator 109 further controls the multiplexer 111 to couple the output node Ni to the driver end Nd in the period W3, so as to drive the $i^{th}$ pixel column. Thus, power consumption by the driver sub-circuit 10(*i*) may be effectively reduced by the foregoing switching operation on the multiplexer 111.

FIG. 4 shows a table of listing operations of the multiplexer 111 according to an embodiment of the present disclosure. Several operation examples are described below for further explaining switching operations of the multiplexer 111 in the periods W1 to W4.

Referring to operation examples numbered #2 and #8 in FIG. 4, when the current latch image data Vin_L' correspond to the positive reference level VPOS, and the current and updated latch image data Vin_L' and Vin_L have different levels, it means that a start level of the driving signal Vd is the positive reference level VPOS, and an end level of the driving signal Vd is one of the negative reference level VNEG and the ground reference level GND. Accordingly, the comparator 109 controls the multiplexer 111 to couple the capacitor Cpos to the driver end in the period W1, so as to recycle and store the positive charges at the $i^{th}$ pixel column to the capacitor Cpos.

Referring to operation examples numbered #4 and #6 in FIG. 4, when the updated latch image data Vin_L correspond to the positive reference level VPOS, and the current and updated latch image data Vin_L' and Vin_L correspond to different levels, it means that the end level of the driving signal Vd is the positive reference level VPOS, and the start level is one of the negative reference level VENG and the ground reference level GND. Accordingly, the comparator 109 controls the multiplexer 111 to couple the capacitor Cpos to the driver end Ni in the period W2, so as to pre-charge the $i^{th}$ pixel column with positive charges stored in the capacitor Cpos.

Referring to operation examples numbered #3 and #6 in FIG. 4, when the current latch image data Vin_L' correspond to the negative reference level VNEG, and the current and updated latch image data Vin_L' and Vin_L correspond to different levels, it means that the start level of the driving signal Vd is the negative reference level VNEG, and the end level of the driving signal Vd is one of the positive reference level VPOS and the ground reference level GND. Accordingly, the comparator 109 controls the multiplexer 111 to couple the capacitor Cneg to the driver end Ni in the period W1, so as to recycle and store negative charges at the $i^{th}$ pixel column to the capacitor Cneg.

Referring to operation examples numbered #7 and #8 in FIG. 4, when the updated latch image data Vin_L correspond to the negative reference level VNEG, and the current and updated latch image data Vin_L' and Vin_L correspond to different levels, it means that the end level of the driving signal Vd is the negative reference level VNEG, and the start level of the driving signal Vd is one of the positive reference level VPOS and the ground reference level GND. Accordingly, the comparator 109 controls the multiplexer 111 to couple the capacitor Cneg to the driver end Ni in the period W2, so as to pre-discharge the $i^{th}$ pixel column with negative charges stored in the capacitor Cneg.

Referring to the operation examples numbered #4 and #7 in FIG. 4, when the current latch image data Vin_L' correspond to the ground reference level GND, it means that the start level of the driving signal Vd is the ground reference level GND. Accordingly, the comparator 109 controls the multiplexer 111 to couple the ground power rail 113 to the driver end Ni in the period W1. Also refer to operation examples numbered #1 to #3 in FIG. 4.

Referring to the operation examples numbered #2 and #3 in FIG. 4, when the updated latch image data Vin_L correspond to the ground reference level GND, it means that the end level of the driving signal Vd is the ground reference level GND. Accordingly, the comparator 109 controls the multiplexer 111 to couple the ground power rail 113 to the driver end Ni in the period W2.

Referring to the operation example numbered #1 in FIG. 4, when the current and updated latch image data Vin_L' and Vin_L both correspond to the ground reference level GND, it means that the driving signal Vd is not to be switched, and sustains at the fixed level. Accordingly, the comparator 109 controls the multiplexer 111 to couple the output node Nd to the ground power rail 113 in the periods W1 and W2.

Referring to the operation examples number #5 and #9 in FIG. 4, when the current and updated latch image data Vin_L' and Vin_L both correspond to the positive reference level VPOS, it means that the driving signal Vd is not to be switched, and the driver sub-circuit 10(*i*) is not required to drive the $i^{th}$ pixel column in the driving period TP. Accordingly, the comparator 109 controls the multiplexer 111 to couple the output node Nd to the driver end Ni in the periods W1 and W2. Similarly, when the current and updated latch image data Vin_L' and Vin_L both correspond to the negative reference level VNEG, the comparator 109 controls the multiplexer 111 to couple the output node Nd to the driver end Ni in the periods W1 and W2.

In conclusion, the driver sub-circuit 10(*i*) according to the embodiment is capable of recycling and storing positive and negative charges at the $i^{th}$ pixel column to the capacitors Cpos and Cneg in the period W1, and reuses the positive and negative charges in the capacitors Cpos and Cneg in the period W2. The driver sub-circuit 10(*i*) according to the embodiment further couples the output node Nd to the driver end Ni in the period W3, i.e., after the charges are fed back and recycled, so that the driver sub-circuit 10(*i*) drives the $i^{th}$ pixel column.

The period W4 is triggered between the periods W1 and W2. The comparator 109 controls the multiplexer 111 to selectively couple the ground power rail 113 to the driver end Ni in the period W4.

Referring to the operation examples numbered #1 to #4 and #6 to #8 in FIG. 4, when the current and updated latch image data Vin_L' and Vin_L do not both correspond to the positive reference level VPOS (i.e., other operation examples except the operation example #5), or do not both correspond to the negative reference level VNEG (i.e., other operation examples except the operation example #9), the comparator 109 controls the multiplexer 111 to couple the ground power rail 113 to the driver end Ni in the period W4, so as to correspondingly provide the ground reference voltage to the $i^{th}$ pixel column.

Referring to the operation examples numbered #5 and #9 in FIG. 4, when the current and updated latch image data Vin_L' and Vin_L both correspond to the positive reference level VPOS, the comparator 109 controls the multiplexer 111 to couple the output node Nd to the driver end Ni in the period W4. When the current and updated latch image data Vin_L' and Vin_L both correspond to the negative reference level VNEG, the comparator 109 controls the multiplexer 111 to couple the output node Nd to the driver end Ni in the period W4.

In this embodiment, situations of the driving period TP divided into four periods W1 to W4 are taken as examples, and are not to be construed as limitations of the data driver 10 of the present disclosure. In another embodiment, the comparator 109 may also omit the period W4 and complete driving operations in the three periods W1 to W3, as shown in FIG. 5.

Figure 7:
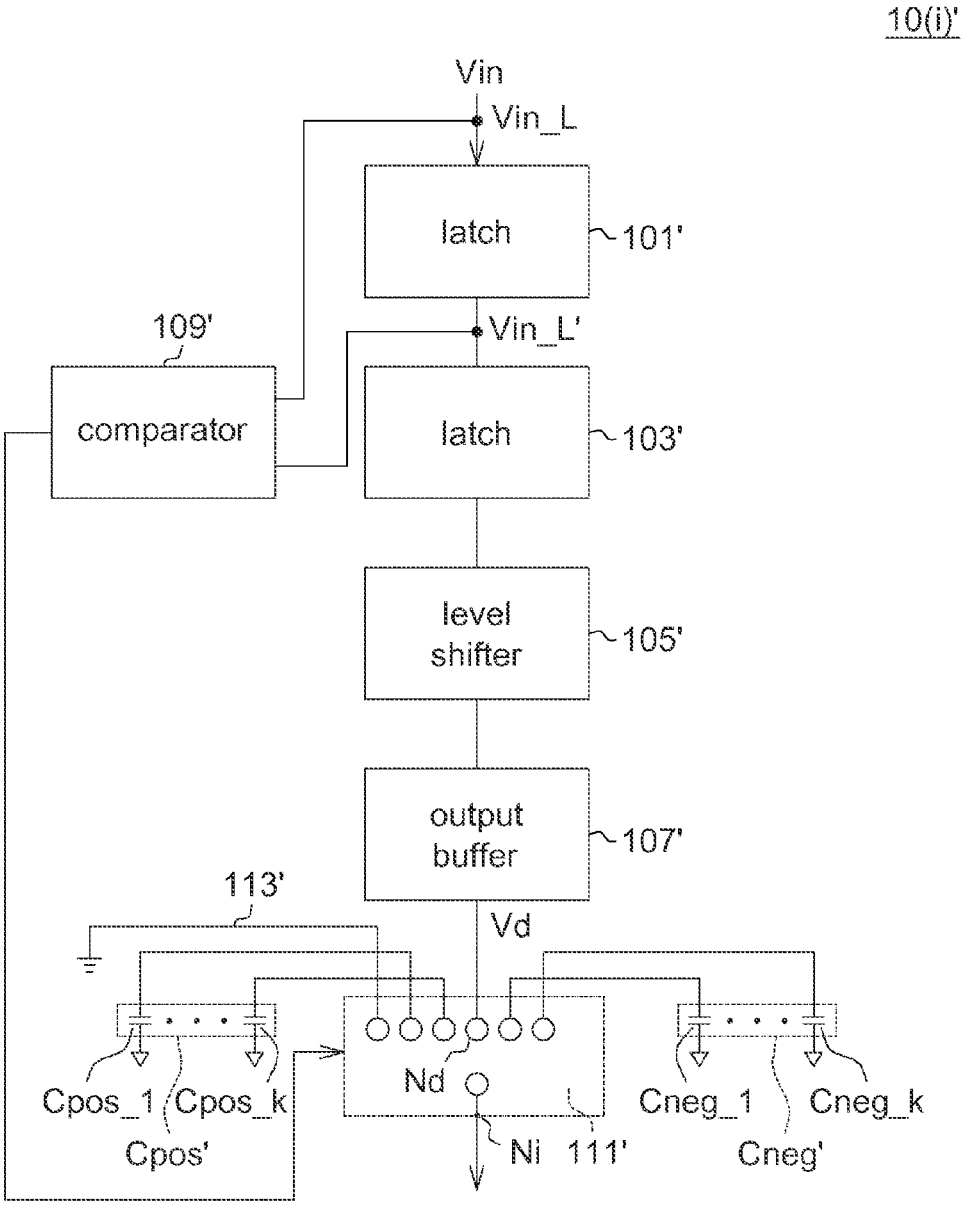
FIG. 7 is a detailed block diagram of the driver sub-circuit 10(*i*)'.
Figure 9A:
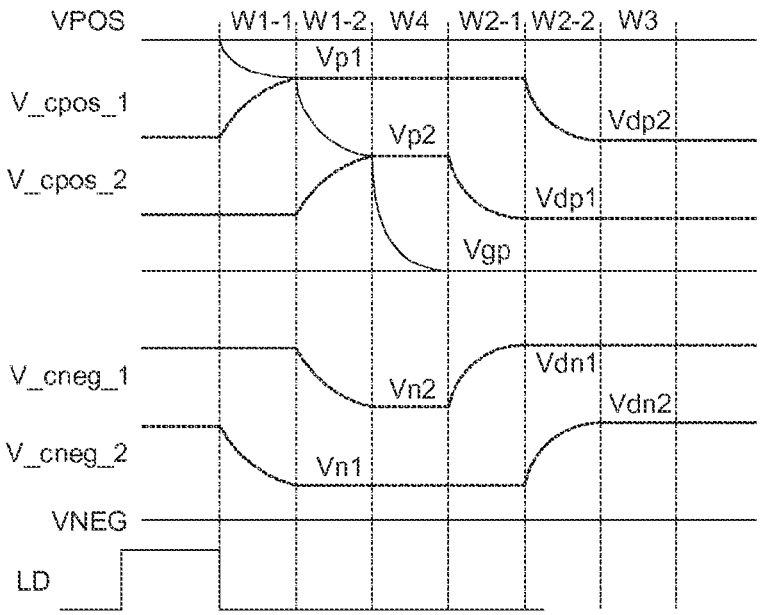
FIGS. 9A to 9F are timing diagrams of associated signals in a driver sub-circuit 10(*i*)".
Figure 9B:
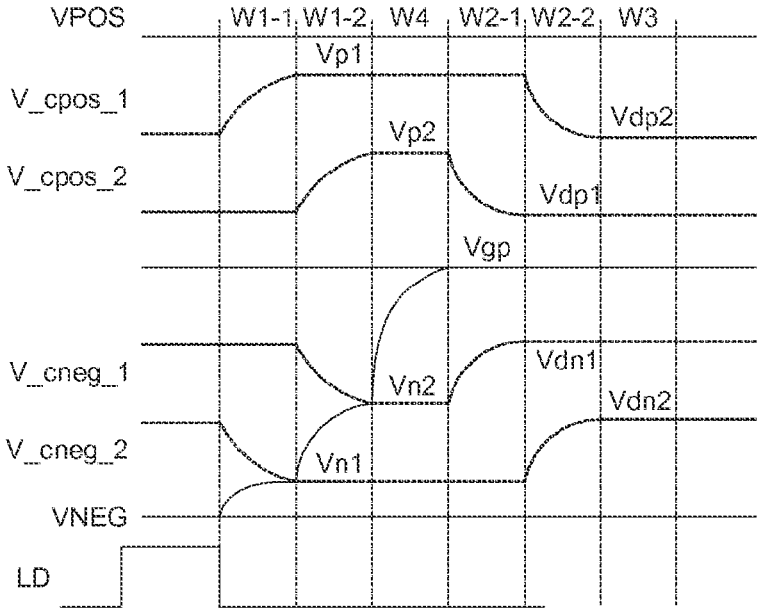
Figure 9C:
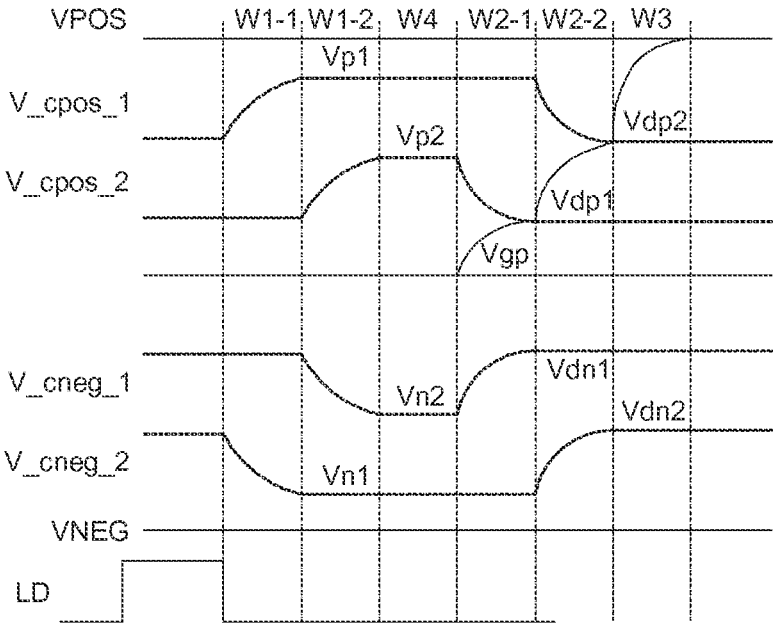
Figure 9D:
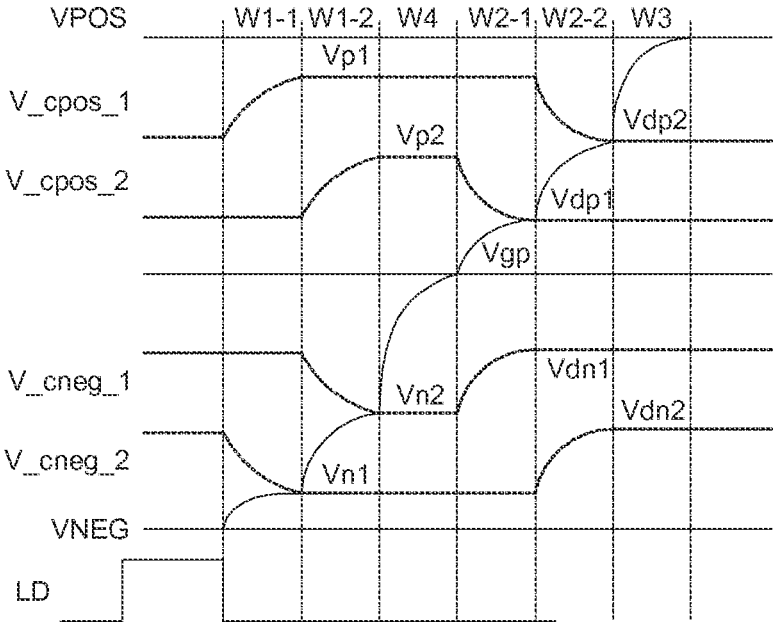
Figure 9E:
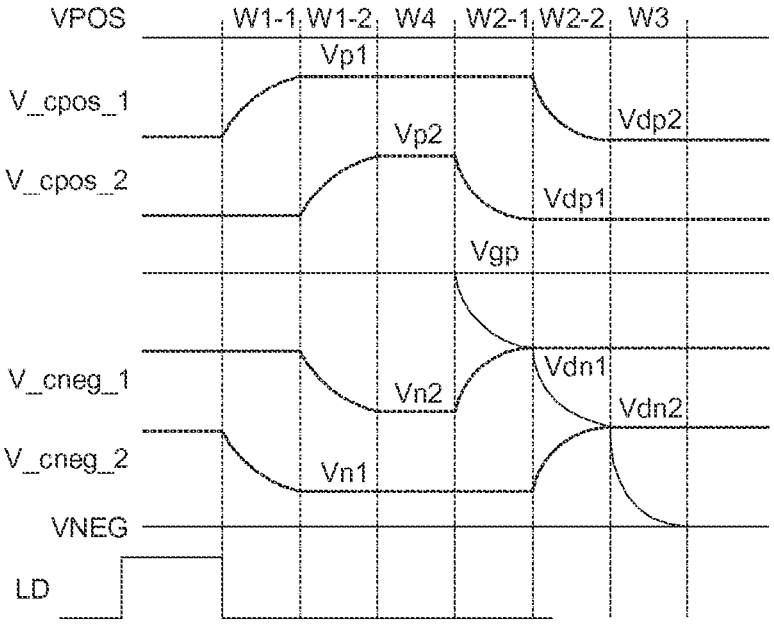
Figure 9F:
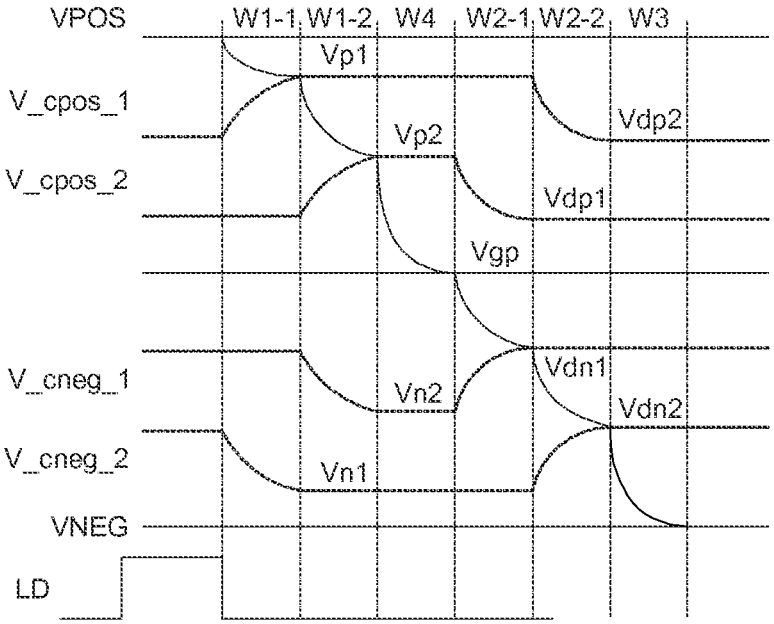

In another embodiment, for example, a capacitor Cpos' includes two or more sub-capacitors Cpos_1, Cpos_2, . . . and Cpos_k, and a capacitor Cneg' includes two or more sub-capacitors Cneg_1, Cneg_2, . . . and Cneg_k, where k is a natural number greater than 1, as shown in FIG. 7.

In the embodiment shown in FIG. 7, a multiplexer 111' correspondingly has 2k+2 inputs respectively coupled to k sub-capators Cpos_1 to Cpos_ki, k sub-capacitors Cneg_1 to Cneg_k, the output node Nd and a ground power rail 113'. Moreover, the comparator 109 may further respectively divide the periods W1 and W2 into k sub-periods W1_1 to W1_k and k sub-periods W2_1 to W2_k, as shown in FIG. 8.

In each of the k sub-periods W1_1 to W1_k, the comparator 109' respectively couples the corresponding sub-capacitors Cpos_1 to Cpos_k or the sub-capacitors Cneg_1 to Cneg_k to the driver end Ni, so as to recycle and store the positive charges at the $i^{th}$ pixel column to the sub-capacitors Cpos_1 to Cpos_k, and to recycle and store the negative charges at the $i^{th}$ pixel column to the sub-capacitors Cneg_1 to Cneg_k. In the k sub-periods W2_1 to W2_k, the comparator 109' respectively couples the corresponding sub-capacitors Cpos_1 to Cpos_k or the sub-capacitors Cneg_1 to Cneg_k to the driver end Ni, so as to provide the recycled and stored positive and negative charges to the $i^{th}$ pixel column for pre-charge or pre-discharge.

Thus, through the switching operations of the sub-periods W1_1 to W1_k and W2_1 to W2_k, the driver sub-circuit 10(*i*)' of the embodiment may recycle and reuse charges at the $i^{th}$ pixel column.

FIGS. 9A to 9F show timing diagrams of associated signals in the driver sub-circuit 10(*i*)' in FIG. 7. Taking k equal to 2 for example, waveforms of associated signals in operation examples numbered #2 to #4 and #6 to #8 in FIG. 8 are as respectively shown in FIGS. 9A to 9F.

Figure 10:
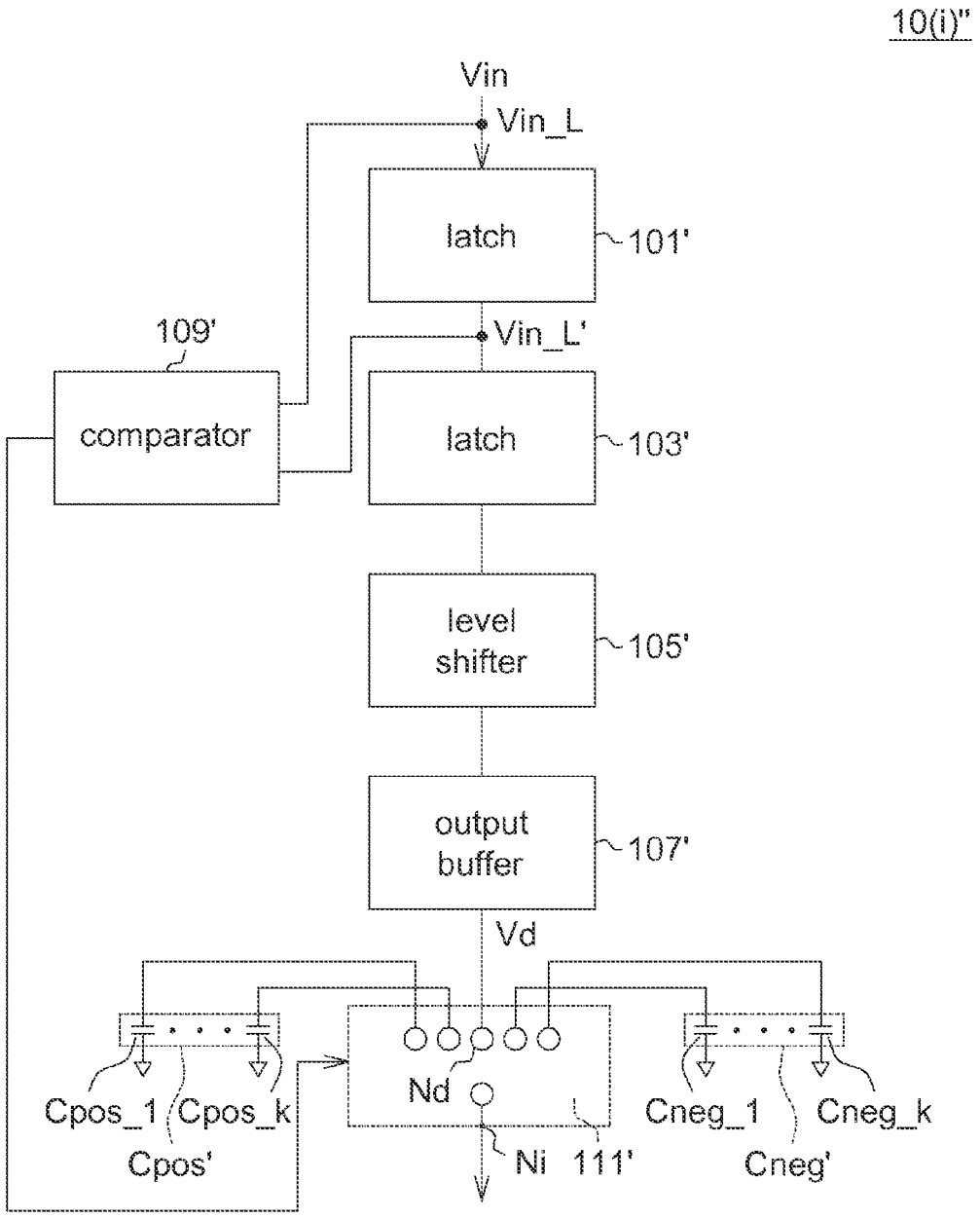
FIG. 10 is a detailed block diagram of the driver sub-circuit 10(*i*)".

FIG. 10 shows a detailed block diagram of the driver sub-circuit 10(*i*)"; and FIGS. 6A to 6F show timing diagrams of associated signals in the driver sub-circuit 10(*i*)". In another embodiment, the operation examples in FIGS. 9A to 9F may also omit the period W4, with the operation period TP being divided to only periods W1_1, W1_2, W2_1, W2_2 and W3, in which corresponding driving operations are performed.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A data driver for an electrophoretic display (EPD), comprising a plurality of driver sub-circuits, each of the driver sub-circuits driving a pixel column of the EPD in a driving period via a driver end; wherein each of the driver sub-circuits comprises:

an output node;

a first latch and a second latch, for respectively storing updated latch image data and current latch image data in response to original image data, the second latch further providing the current latch image data to the output node, the updated latch image data and the current latch image data each selectively corresponding individually to one of a positive reference level, a negative reference level and a ground reference level;

a multiplexer, coupled to a first capacitor, a second capacitor, the output node and the driver end; and a comparator, dividing the driving period into a first period, a second period and a third period, wherein when the updated latch image data and the current latch image data selectively correspond to different levels, the comparator controls the multiplexer to selectively couple one of the first and second capacitors to the driver end in the first period to recycle charges at the pixel column into the coupled one of the first and second capacitors, and to selectively couple said one of the first and second capacitors to the driver end in the second period to pre-charge or pre-discharge the pixel column with the recycled charges in the coupled one of the first and second capacitors, wherein when the current latch image data correspond to the positive reference level, and the updated and current latch image data correspond to different levels, the comparator controls the multiplexer to couple the first capacitor to the driver end in the first period to recycle positive charges at the pixel column to the first capacitor.

2. The data driver according to claim 1, wherein when the updated latch image data correspond to the positive reference level, and the updated and current latch image data correspond to different reference levels, the comparator controls the multiplexer to couple the first capacitor to the driver end in the second period to precharge the pixel column with the positive charges in the first capacitor.

3. The data driver according to claim 2, wherein the first capacitor comprises a plurality of sub-capacitors, and the multiplexer correspondingly comprises a plurality of inputs respectively coupled to the sub-capacitors;

the comparator correspondingly divides the first period into a plurality of first sub-periods, and respectively conducts the sub-capacitors in the first sub-periods to recycle the positive charges to the sub-capacitors; and the comparator correspondingly divides the second period into a plurality of second sub-periods, and respectively conducts the sub-capacitors in the second sub-periods to pre-charge the pixel column with the positive charges in the sub-capacitors.

4. The data driver according to claim 1, wherein when the current latch image data correspond to the negative reference level, and the updated and current latch image data correspond to different levels, the comparator controls the multiplexer to couple the second capacitor to the driver end in the first period to recycle negative charges at the pixel column to the second capacitor.

5. The data driver according to claim 4, wherein when the updated latch image data correspond to the negative reference level, and the updated and current latch image data correspond to different levels, the comparator controls the multiplexer to couple the second capacitor to the driver end in the second period to pre-discharge the pixel column with the negative charges in the second capacitor.

6. The data driver according to claim 5, wherein the second capacitor comprises a plurality of sub-capacitors, and the multiplexer correspondingly comprises a plurality of inputs respectively coupled to the sub-capacitors;

the comparator correspondingly divides the first period into a plurality of first sub-periods, and respectively conducts the sub-capacitors in the first sub-periods to recycle the negative charges to the sub-capacitors; and the comparator correspondingly divides the second period into a plurality of second sub-periods, and respectively conducts the sub-capacitors in the second sub-periods to pre-discharge the pixel column with the negative charges in the sub-capacitors.

7. The data driver according to claim 1, wherein the multiplexer is further coupled to a ground power rail providing the ground reference level.

8. The data driver according to claim 7, wherein when the current latch image data correspond to the ground reference level, the comparator controls the multiplexer to couple the ground power rail to the driver end in the first period; and when the updated latch image data correspond to the ground reference level, the comparator controls the multiplexer to couple the ground power rail to the driver end in the second period.

9. The data driver according to claim 7, wherein the comparator further divides a fourth period in the driving period, and controls the multiplexer to selectively couple the ground power rail to the driver end in the fourth period, the fourth period triggered between the first and second periods.

10. The data driver according to claim 9, wherein when the updated and current latch image data do not both correspond to the positive reference level, the comparator controls the multiplexer to couple the ground power rail to the driver end in the fourth period; and when the updated and current latch image data do not both correspond to the negative reference level, the comparator controls the multiplexer to couple the ground power rail to the driver end in the fourth period.

11. The data driver according to claim 1, wherein when the updated and current latch image data both correspond to the positive reference level, the comparator controls the multiplexer to couple the output node to the driver end in the first and second periods; and when the updated and current latch image data both correspond to the negative reference level, the comparator controls the multiplexer to couple the output node to the driver end in the first and second periods.

12. The data driver according to claim 1, wherein the comparator further controls the multiplexer to couple the output node to the driver end in the third period to drive the pixel column.

* * * * *